US007896064B2

(12) United States Patent
Fulmer

(10) Patent No.: US 7,896,064 B2
(45) Date of Patent: Mar. 1, 2011

(54) PLATE-TYPE HEAT EXCHANGER

(75) Inventor: Jason Michael Fulmer, Wichita Falls, TX (US)

(73) Assignee: Tranter, Inc., Wichita Falls, TX (US)

( * ) Notice: Subject to any disclaimer, the term of this patent is extended or adjusted under 35 U.S.C. 154(b) by 1120 days.

(21) Appl. No.: 11/475,673

(22) Filed: Jun. 27, 2006

(65) Prior Publication Data

US 2007/0295479 A1 Dec. 27, 2007

(51) Int. Cl.
*F28D 9/02* (2006.01)

(52) U.S. Cl. ..... 165/157; 165/166

(58) Field of Classification Search ..... 165/157, 165/166, 167, 906; 220/682
See application file for complete search history.

(56) References Cited

U.S. PATENT DOCUMENTS

| | | | | | |
|---|---|---|---|---|---|
| 383,175 | A * | 5/1888 | Gardner | 229/198.2 |
| 595,494 | A * | 12/1897 | O'Meara | 266/262 |
| 3,311,166 | A * | 3/1967 | Southam | 165/166 |
| 3,451,474 | A * | 6/1969 | Cox | 165/166 |
| 4,653,575 | A * | 3/1987 | Courchesne | 165/54 |
| 5,435,383 | A * | 7/1995 | Rajagopal | 165/167 |
| 5,469,914 | A * | 11/1995 | Davison et al. | 165/166 |
| 6,516,874 | B2 | 2/2003 | Mathur et al. | |
| 6,920,918 | B2 * | 7/2005 | Knecht et al. | 165/157 |
| 2002/0174978 | A1 * | 11/2002 | Beddome et al. | 165/174 |
| 2005/0189097 | A1 * | 9/2005 | Fowser et al. | 165/166 |
| 2006/0201660 | A1 * | 9/2006 | Watanabe | 165/157 |
| 2006/0219394 | A1 * | 10/2006 | Martin et al. | 165/157 |

* cited by examiner

*Primary Examiner*—Allen J Flanigan
(74) *Attorney, Agent, or Firm*—Reising Ethington P.C.

(57) ABSTRACT

A heat exchanger includes a housing and a core having a shell. The shell may have an upper wall, a lower wall, and a pair of opposed side walls interconnecting the upper and lower walls to define at least part of an enclosure in which a fluid may be received. The housing may have an upper plate adjacent to the upper wall, a lower plate adjacent to the lower wall and a pair of side plates each adjacent to a separate one of the side walls. The upper plate may be connected to the lower plate and the side plates may be connected together to support the upper wall, lower wall and side walls of the shell. The support provided by the housing may, in at least some applications, permit use of a lower strength and less expensive shell.

15 Claims, 2 Drawing Sheets

PLATE-TYPE HEAT EXCHANGER

FIELD OF THE INVENTION

The present invention relates generally to heat exchangers and more particularly to plate-type heat exchangers.

BACKGROUND OF THE INVENTION

At least some conventional heat exchangers may be classified into two categories, tubular exchangers and plate exchangers. The conventional plate heat exchangers are manufactured by stacking a plurality of plates, configured in a way so that two fluids, one relatively hot and the other relatively cold, may be passed between alternating channels defined by the plates.

Plate heat exchangers may be broken down into two categories, namely gasket containing heat exchangers and welded heat exchangers. Gasketed exchangers can provide accessibility of plates for cleaning, lower thermal stresses, and cost per area. However, some gasket limitations may occur with temperature, pressure and compatibility with fluids used. One problem encountered with existing welded heat exchanger units is the high thermal stresses present which can lead to shorter equipment life. High manufacturing cost of separating the relatively hot and relative cold fluid via common welding procedures is another potential disadvantage.

SUMMARY OF THE INVENTION

A heat exchanger may include a housing and a core having a shell. The shell may have an upper wall, a lower wall, and a pair of opposed side walls interconnecting the upper and lower walls to define at least part of an enclosure in which a fluid may be received. The housing may have an upper plate adjacent to the upper wall, a lower plate adjacent to the lower wall and a pair of side plates each adjacent to a separate one of the side walls. The upper plate may be connected to the lower plate and the side plates may be connected together to support the upper wall, lower wall and side walls of the shell. The support provided by the housing may, in at least some applications, permit use of a lower strength and less expensive shell.

In one presently preferred implementation, the heat exchanger core includes upper and lower walls and a pair of side walls interconnecting the upper and lower walls, and the housing surrounds at least a portion of each of the top and bottom walls and the side walls. The housing may be made of a plurality of plates releasably connected together to permit access to the core, as desired. This implementation allows the walls to be manufactured via flame cutting instead of traditional machining. Of course, other implementations, modifications and/or substitutions may be utilized as desired for a particular application.

BRIEF DESCRIPTION OF THE DRAWINGS

These and other objects, features, and advantages of the present invention will be apparent from the following detailed description of preferred embodiments and best mode, appended claims, and accompanying drawings in which:

DETAILED DESCRIPTION OF PREFERRED EMBODIMENTS

Referring in more detail to the drawings, FIGS. 1-4 illustrate one exemplary embodiment of a heat exchanger 10 including an outer support housing 12 and an inner core 14. The heat exchanger 10 is shown as a plate heat exchanger having a basically rectangular core 14, although other shapes and configurations are possible. It is the intention of the drawings and this description to show exemplary embodiments of the invention and in no way limit the construction, arrangement, or method in which the invention is embodied.

Figure 5:
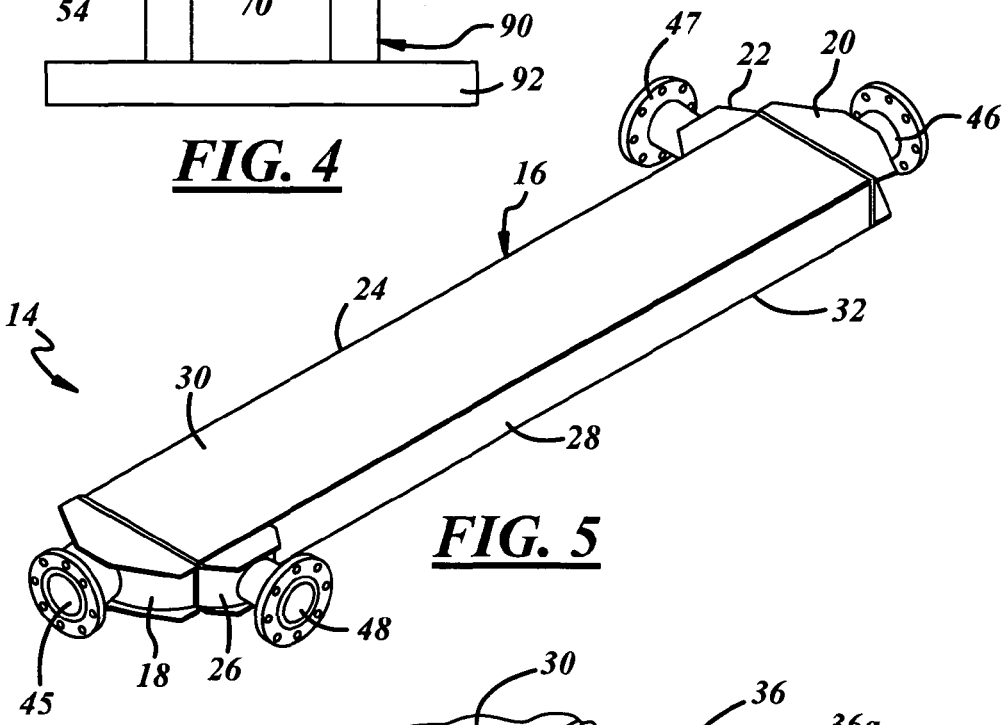
FIG. 5 is a perspective view of a welded plate heat exchanger core which may be used in the assembly shown in FIG. 1.
Figure 6:
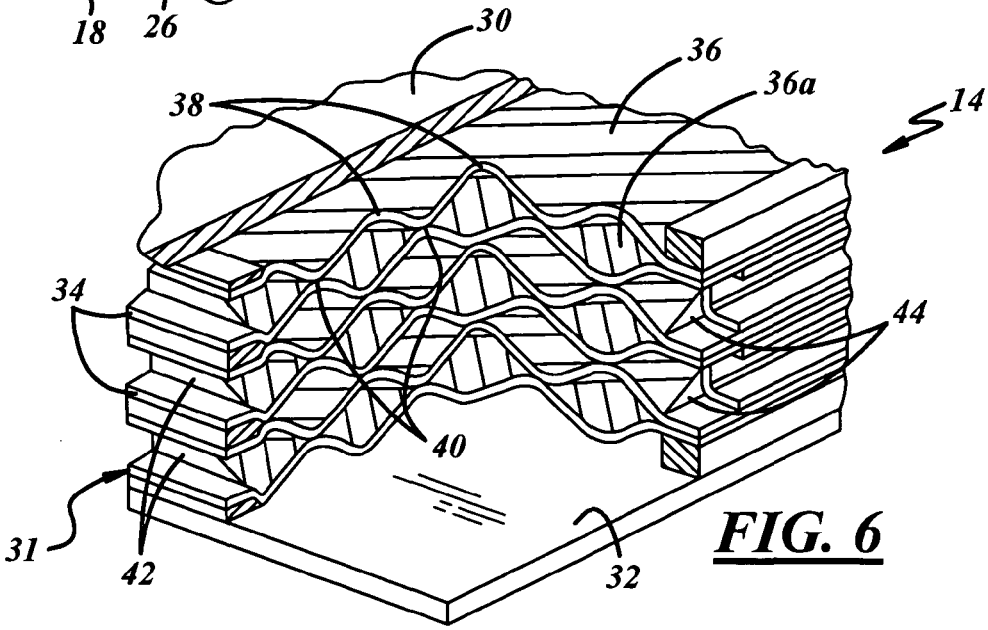
FIG. 6 is a fragmentary perspective sectional view of the core of FIG. 5 showing a portion of plates within the interior of the core.

As best shown in FIG. 5, the core 14 includes an outer shell 16 consisting of a primary inlet header 18, a primary outlet header 20, a secondary inlet header 22 forming a portion or all of one sidewall 24 of the shell 16, a secondary outlet header 26 forming a portion or all of another sidewall 28 of the shell, a top wall 30, and a bottom wall 32. The headers 18, 20, 22, 26, and the walls 30, 32 are interconnected to enclose a plate assembly 31 a portion of which is shown in FIG. 6. The headers 18, 20, 22, 26 and the walls 30, 32 may be welded together to define an at least substantially complete enclosure. The secondary inlet and outlet headers 22 and 26 and the walls 30, 32 may be generally flat plates providing a generally box shaped or rectangular parallelepiped shaped shell 16.

As best shown in FIG. 6, the internal arrangement and construction of the core 14, including the plate assembly 31, can be substantially as disclosed in U.S. Pat. No. 6,516,874, the disclosure of which is incorporated herein by reference in its entirety. In general, located within the shell 16 are a plurality of cassettes, each identified by reference numeral 34 that form a part of the plate pack assembly 31. Each cassette 34 is constructed from two rectangular heat transfer plates 36 and **36*a* the central body portion of each of which is formed with a plurality of parallel and angled corrugations or depressions. In forming a cassette 34, one of the heat transfer plates 36, 36*a* is rotated 180 degrees and turned over so that one of the plates is superimposed upon the other. As seen in FIG. 6, this causes the corrugations of each of the heat transfer plates 36, 36*a* to cross each other at a fixed angle and provide plurality of parallel and angled outer ridges 38 and inner ridges 40 for each of the heat transfer plates 33, 33*a***.

As seen in FIGS. 5 and 6, the cassettes 34 within the core of the heat exchanger 10 provide primary channels 42 for the flow of a primary fluid and secondary channels 44 for the flow of a secondary fluid. The primary fluid enters the heat exchanger 10 through a primary inlet nozzle 45 which is rigidly connected to an arcuately shaped inlet header 18. The primary fluid exits through a primary outlet nozzle 46 which is rigidly connected to the arcuately shaped outlet header 20. Accordingly, primary fluid entering the heat exchanger 10 via the primary inlet nozzle 45, flows through the primary channels 42, and exits the heat exchanger 10 through the primary outlet nozzle 46. The secondary fluid enters the heat exchanger 10 via the secondary inlet nozzle 47, flows through the secondary channels 44, and exits through the secondary outlet nozzle 48. As should be apparent, the inlet nozzle 47 and the outlet nozzle 48 are rigidly connected to the secondary inlet header 22 and the secondary outlet header 26, respectively.

As shown in FIGS. 1-4, the support housing 12 includes opposed upper and lower plates, 52, 54 and a pair of opposed side plates 56, 58 all arranged in close proximity to the outer surface of the shell 16 of the core 14. The plates 52-58 preferably are connected together and are rigid so that the support housing 12 is rigid and resists deformation in assembly and can support at least portions of the shell 16 against undue expansion. The housing 12 preferably supports at least a portion of three sides of the shell 16, and preferably a substantial portion (e.g. more than half the surface area) of three or more sides of the shell 16. This may permit the core shell 16 to be formed of thinner, or less robust material. In at least some embodiments, this can reduce the cost of the heat exchanger assembly because, for example, the shell material which is in contact with fluid typically is formed from a relatively expensive material such as stainless steel, and less of that material may be needed. The support housing 12, on the other hand, does not contact the fluid and can be formed of less expensive carbon steel. Further, a reduction in machining and welding can be realized, and the support plates 52-58 can be flame cut (or otherwise) and relatively unfinished thereby further reducing the cost to manufacture and assembly the heat exchanger 10.

The opposed pair of upper and lower plates 52, 54 and opposed pair of side plates 56, 58 may be connected together to define an at least substantially complete enclosure in which the core 14 is received. In one presently preferred implementation, a plurality of connection features 60 are used to releasably connect adjacent plates together so that the housing 12 may be taken apart and the core 14 removed for repair or replacement with a new core. In the implementation shown, the connection features 60 include fingers spaced along the plates 52-58 and connectors 64 that connect together the fingers of adjacent plates. Due to the relatively high number of fingers and connectors in the particular embodiment shown in the drawings, not all of these parts have been labeled on the drawings. Rather, to facilitate viewing and understanding the drawings, only a representative number of such parts have been labeled on the drawings.

Figure 1:
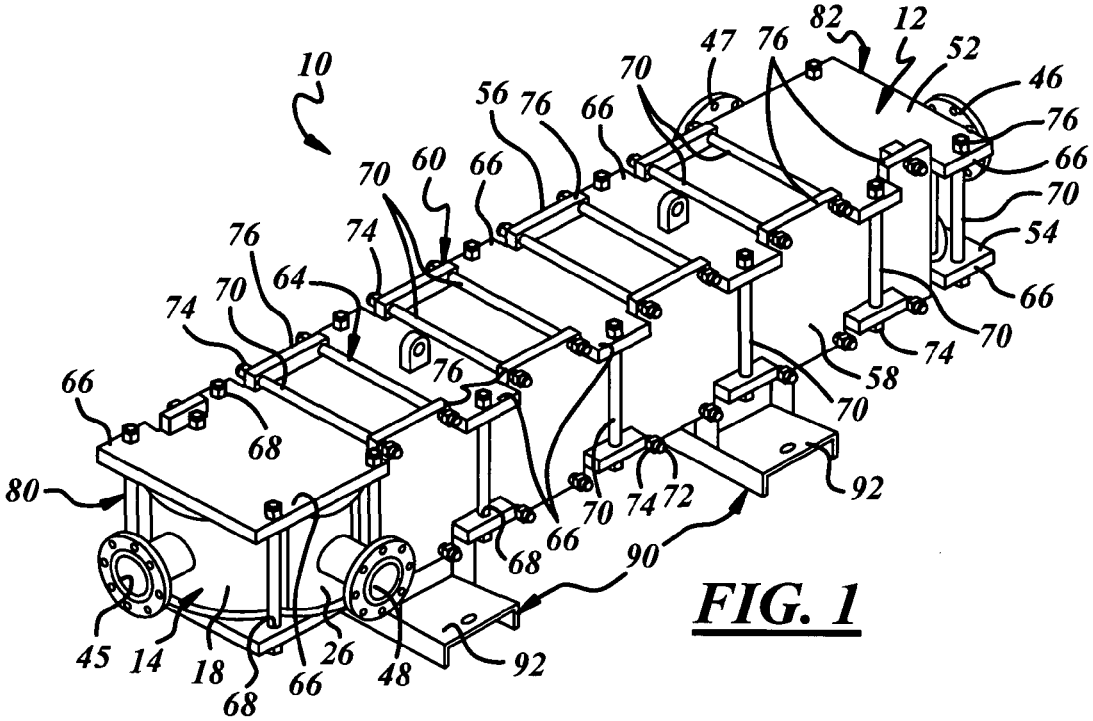
FIG. 1 is a perspective view of one presently preferred embodiment of a heat exchanger.
Figure 2:
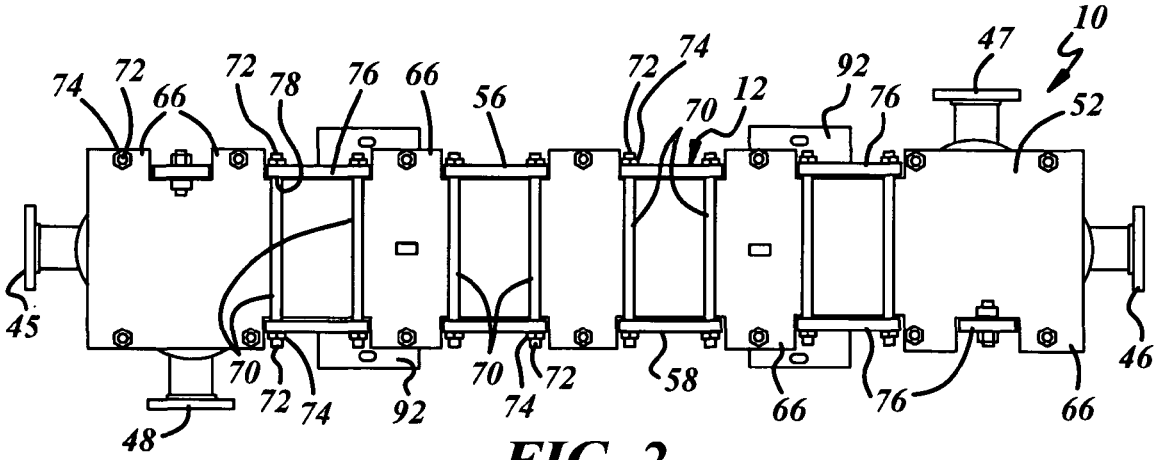
FIG. 2 is a plan view of the heat exchanger of FIG. 1.
Figure 3:
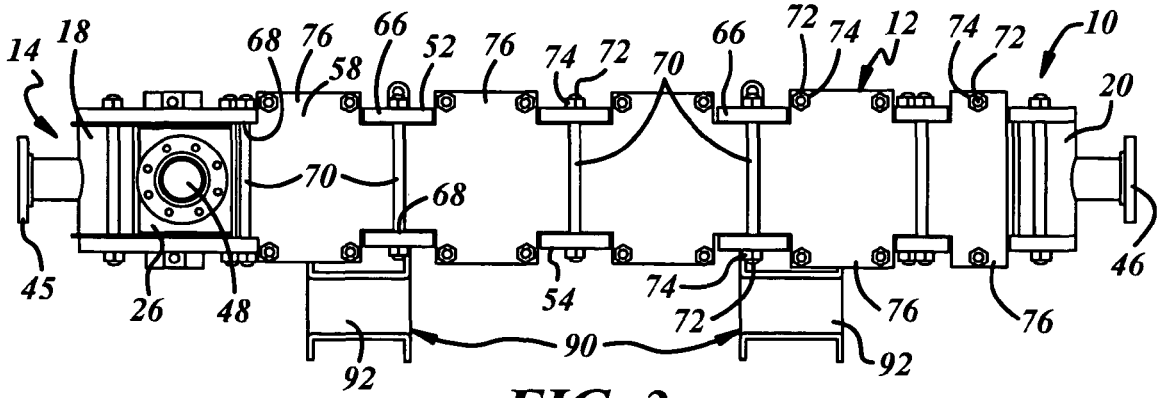
FIG. 3 is a side view of the heat exchanger of FIG. 1.
Figure 4:
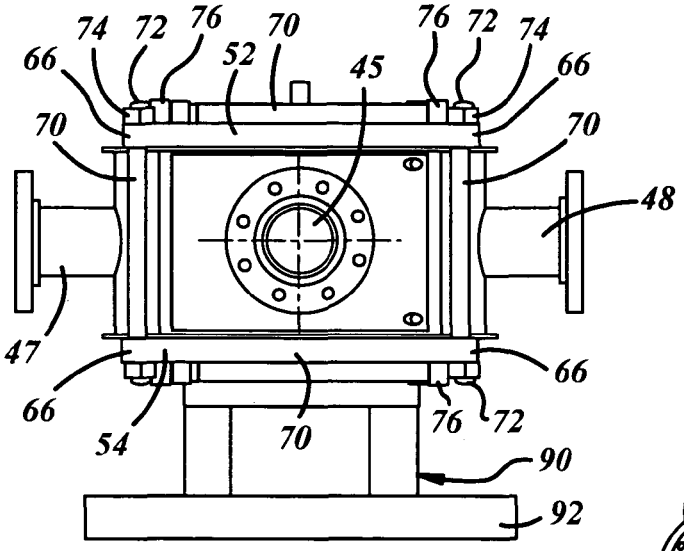
FIG. 4 is an end view of the heat exchanger.

More specifically, as best shown in FIGS. 1-3, the upper and lower plates 52, 54 may be of identical construction. The plates 52, 54 may be generally planar with fingers 66 that are spaced apart and extend outwardly from opposed sides of each plate 52, 54. The fingers 66 on one side of a plate extend away from the fingers 66 on the other side of that plate, and the plates 52, 54 preferably may be arranged so that the fingers 66 on the upper plate 52 are aligned with the fingers 66 of the lower plate 54. Each finger 66 preferably has at least one opening 68 therethrough. The openings 68 in aligned fingers 66 of the upper and lower plates 52, 54 are aligned to receive a connector 64 therethrough so that the aligned fingers 66 can be connected together. As shown, the connector 64 may include a rod 70 having threaded ends 72 and nuts 74 may be tightened on each end 72 of the rod 70.

The side plates 56, 58 may be identical and are preferably arranged similarly to the upper and lower plates 52, 54 but are located adjacent to the sidewalls 24, 28 of the core 14. The side plates 56, 58 include outwardly extending fingers 76 with the fingers 76 on one side plate 56 aligned with the fingers 76 on the other side plate 58. The fingers 76 of the side plates 56, 58 also preferably include at least one opening 78 therethrough with the openings 78 in the fingers 76 of one side plate 56 aligned with the openings 78 in respective fingers 76 of the other side plate 58 to facilitate connecting the fingers 76 of the side plates 56, 58 together. The fingers 76 of the side plates 56, 58 preferably are received in the gaps between and interspersed with adjacent fingers 66 of the upper and lower plates 52, 54. The fingers 76 of the side plates 56, 58 may extend at right angles to the fingers 66 of the upper and lower plates 52, 54. Rods 70 may extend through the openings 78 of aligned fingers 76 of the side plates 56, 58 and nuts 74 preferably are tightened on each end 72 of the rods 70.

In this manner, the connectors 64 clamp aligned fingers 66 of the upper and lower plates 52, 54 together and against associated walls or surfaces of the core. Likewise, connectors 64 clamp aligned fingers 76 of the side plates 56, 58 together and against associated walls of the core. In one presently preferred implementation, the side plates 56, 58 do not touch the upper and lower plates 52, 54. A one-quarter inch tolerance may be provided at all plate to plate interfaces so that the clamping force is applied to the shell, not the adjacent panels. By way of one alternate example, the plates 52, 54, 56, and 58 may engage each other and be received closely adjacent to the core to prevent undue expansion of or stresses in the core.

So all of the plates 52-58 are connected together, and may be disconnected by removing the nuts 74 to permit access to the core 14. The rods 70 connecting together the side plates 56, 58 may extend parallel to and outboard of the upper and lower plates 52, 54. The rods 70 connecting together the upper and lower plates 52, 54 may extend parallel to and outboard of the side plates 56, 58. The ends 80, 82 of the housing 12 may be open to permit one or more inlets 45 and outlets 46 to extend therethrough for connection to suitable conduits or the like. Otherwise one or all of the ends 80, 82 could be overlied and supported by separate plates or by portions of the upper, lower or side plates that extend adjacent to the ends. Therefore, the support housing 12 in the implementation shown provides rigid support to four sides of the core 14. Support may be provided to more or fewer sides, as desired for a particular application, and provision, such as openings through one or more of the plates of the support housing, can be made for the inlets and outlets, or otherwise, as needed.

The support housing 12 may be received on one or more brackets 90 to facilitate connecting the heat exchanger 10 to and space it from another structure. The brackets 90 may include outwardly extending feet 92 and preferably are spaced along the length of the heat exchanger 10.

The above description of certain embodiments of the invention is merely exemplary in nature and, thus, variations, modifications and/or substitutions thereof are not to be regarded as a departure from the spirit and scope of the invention. By way of example without limitation, while the support housing 12 in the exemplary embodiment shown and described may be disassembled and removed from the core 14, the support housing 12 could be welded or otherwise more or less permanently assembled providing limited or no access to the core 14. Further, while shown and described as including metal plates, a portion or all of the support housing 12 may be formed of other materials, as desired for a particular application. An apparatus or assembly embodying the present invention may have none, some, or all of the noted features and/or advantages. That certain features are included in the presently preferred embodiments set forth herein should not be constructed to mean that all embodiments of the present invention must have such features.

The invention claimed is:

1. A heat exchanger, comprising:

a core including a shell having a plurality of sides, and at least one fluid channel in which fluid is circulated;

a housing separate from and surrounding at least a portion of each of said sides of the shell to support said sides of the shell against the pressure of fluid therein, the housing including two opposed pairs of plates, with the fingers of the plates in one of the opposed pairs being removably connected together at locations outboard of the other of the opposed pair of plates, and the fingers of the plates of the other of the opposed pairs being removably connected together at locations outboard of the one of the opposed pairs and with each plate of the housing directly engaging an adjacent side of the shell so that opposed pairs of plates engage opposed sides of the shell, wherein the plates in one pair of opposed plates do not touch the plates in the other pair of opposed plates so that clamping forces are applied to the shell and not to adjacent plates.

2. The heat exchanger of claim 1 wherein the plates of said one of the opposed pairs are connected together and engaged with the plates of the other of the opposed pairs, and the plates of said other of the opposed pairs are also connected together and engaged with the plates of said one of the opposed pairs.

3. The heat exchanger of claim 1 wherein at least one of the fingers of a plate in one of the opposed pairs is disposed between two of the fingers of a plate in the other of the opposed pairs.

4. The heat exchanger of claim 3 wherein a plurality of fingers of each plate are disposed between adjacent fingers of an adjacent plate.

5. The heat exchanger of claim 2 wherein the connector includes a threaded portion and a nut removably received on the threaded portion.

6. The heat exchanger of claim 5 wherein the connector includes a rod having threaded ends and nuts received on each end of the rod.

7. The heat exchanger of claim 4 wherein the fingers of each aligned pair of plates extend outwardly beyond the adjacent portion of the other pair of opposed plates.

8. The heat exchanger of claim 1 wherein said plurality of fingers each include an opening therethrough with the openings of aligned fingers of each opposed pair of plates being disposed outboard of the other pair of opposed plates and adapted to receive a connector disposed outboard of the other pair of opposed plates.

9. A heat exchanger, comprising:

a core having a shell with an upper wall, a lower wall, and a pair of opposed side walls interconnecting the upper and lower walls to define at least part of an enclosure in which a fluid may be received;

a housing having an upper plate adjacent to the upper wall, a lower plate adjacent to the lower wall and a pair of side plates each adjacent to a separate one of the side walls, the upper plate being connected to the lower plate and the side plates being connected together to support the upper wall, lower wall and side walls of the shell, wherein the upper and lower plates of the housing do not touch the side plates of the housing, and vise versa;

wherein the upper and lower plates of the housing include fingers interspersed with fingers of the side plates, and the fingers of the upper and lower plates being removably connected together at locations outboard of the side plates, and the fingers of the side plates being removably connected together at locations outboard of the upper and lower plates.

10. The heat exchanger of claim 9 wherein the shell is formed of a material suitable for contact with a fluid circulated in the core and the housing is formed from a carbon steel.

11. The heat exchanger of claim 9 wherein the plates are connected together by threaded fasteners.

12. The heat exchanger of claim 9 wherein the side plates are clamped together and against the core, and the upper and lower plates are clamped together and against the core.

13. The heat exchanger of claim 12 wherein the clamping force is provided by a plurality of connectors.

14. A heat exchanger, comprising:

a core having a shell with a first pair of opposed walls and a second pair of opposed walls to define at least part of an enclosure in which a fluid may be received; and a housing having a first pair of opposed plates disposed against the first pair of opposed walls of the core and a second pair of opposed plates disposed against the second pair of opposed walls of the core, wherein the first pair of opposed plates includes first fingers and the second pair of opposed plates includes second fingers interspersed with the first fingers, and wherein at least some of the first fingers of the first pair of opposed plates are releasably connected together at locations outboard of the second pair of opposed plates, and at least some of the second fingers of the second pair of opposed plates are releasably connected together at locations outboard of the first pair of opposed plates and wherein the first pair of opposed plates do not touch the second pair of opposed plates so that clamping forces are applied to the shell and not to adjacent plates.

15. The heat exchanger of claim 14, wherein the first fingers of the first pair of opposed plates are connected together with threaded rods and nuts, and the second fingers of the second pair of opposed plates are connected together with threaded rods and nuts.

* * * * *